US005934952A

United States Patent [19]

Scanlon

[11] Patent Number: 5,934,952

[45] Date of Patent: Aug. 10, 1999

[54] MARINE PROPULSION UNIT

[76] Inventor: Robert Emmett Scanlon, 18304 W. Rim Dr., Jonestown, Tex. 78645

[21] Appl. No.: 09/041,963

[22] Filed: Mar. 13, 1998

[51] Int. Cl.[6] ..... B63H 1/36

[52] U.S. Cl. ..... 440/15; 416/81

[58] Field of Search ..... 440/13–20; 416/81–83

[56] References Cited

U.S. PATENT DOCUMENTS

| | | | |
|---|---|---|---|
| 2,611,321 | 9/1952 | Shafer | 440/15 |
| 3,048,141 | 8/1962 | Fisk . | |
| 3,294,031 | 12/1966 | Latawic . | |

FOREIGN PATENT DOCUMENTS

| | | |
|---|---|---|
| 3033408 | 3/1982 | Germany . |
| 6135383 | 5/1994 | Japan . |
| 238365 | 11/1969 | U.S.S.R. . |
| 751591 | 6/1955 | United Kingdom . |
| 1089033 | 11/1967 | United Kingdom . |

*Primary Examiner*—Jesus D. Sotelo
*Attorney, Agent, or Firm*—Stephen R. Greiner

[57] ABSTRACT

A marine propulsion unit including a conduit having opposed, inlet and outlet ends. A first pivot pin is pivotally secured within the conduit adjacent its inlet end. A second pivot pin is pivotally secured within the conduit adjacent its outlet end. The forward end of a flexible sheet is secured to the first pivot pin, and the rearward end of the flexible sheet extends freely from the outlet end of the conduit. The flexible sheet is also secured to the second pivot pin between the forward and rearward ends thereof in a longitudinally compressed manner so as to impart a waveform to the flexible sheet. At least one crank arm is secured to the first pivot pin for oscillating the first pivot pin to cause the rearward migration of the waveform in the flexible sheet from the first pivot pin to the second pivot pin.

14 Claims, 2 Drawing Sheets

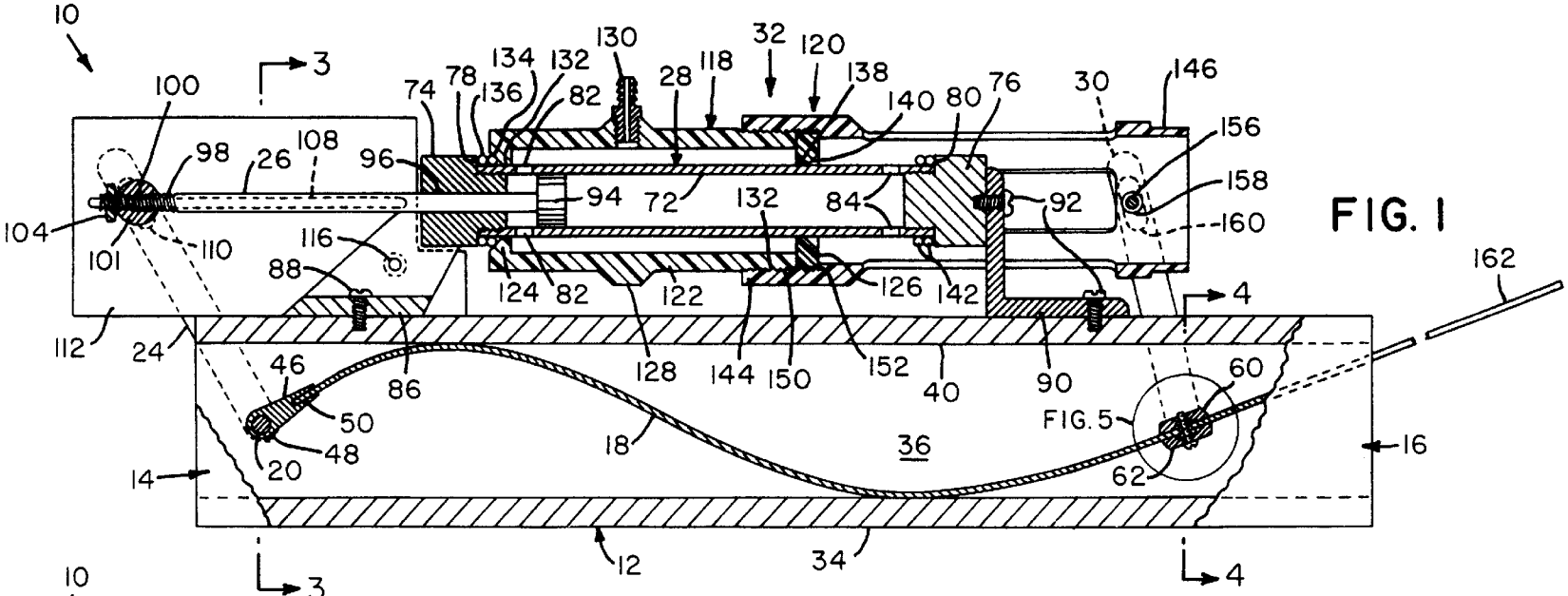
FIG. 1
FIG. 5
10
12
14
16
18
20
24
26
28
30
32
34
36
40
46
48
50
60
62
72
74
76
78
80
82
84
86
88
90
92
94
96
98
100
101
104
108
110
112
116
118
120
122
124
126
128
130
132
134
136
138
140
142
144
146
150
152
156
158
160
162
3
4
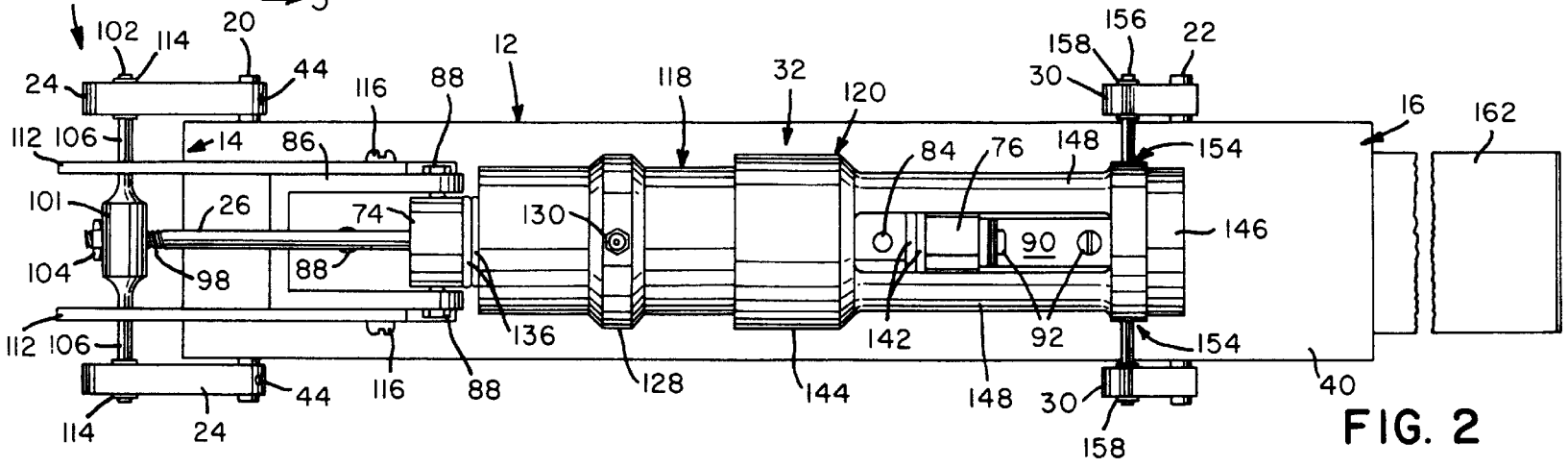
FIG. 2
10
12
14
16
20
22
24
30
32
40
44
74
76
84
86
88
90
92
98
101
104
106
112
114
116
118
120
126
128
130
136
142
144
146
148
154
156
158
162

MARINE PROPULSION UNIT

FIELD OF THE INVENTION

The present invention relates generally to marine propulsion apparatus with oscillating propelling means.

BACKGROUND OF THE INVENTION

Watercraft incorporating undulating sheets for the purpose of propulsion have been proposed in the past to overcome some of the drawbacks and hazards presented by rotating propellers. As a group, however, these watercraft have been complex in construction and inefficient in converting energy into motion over, or through, a water body. Thus, watercraft having undulating sheets for propulsion have not seen widespread commercial acceptance despite their theoretical abilities to operate without noise or cavitation.

SUMMARY OF THE INVENTION

In light of the problems associated with the known watercraft using undulating sheets, it is a principal object of the invention to provide an improved marine propulsion unit having an undulating sheet which is uncomplicated in construction, inexpensive in manufacture, and highly efficient in operation.

Briefly, the marine propulsion unit in accordance with this invention achieves the intended objects by featuring a conduit having inlet and outlet ends. First and second pivot pins are respectively and pivotally secured within the conduit adjacent its inlet and outlet ends. The forward end of a flexible sheet is secured to the first pivot pin, and the rearward end of the sheet extends freely from the outlet end of the conduit. The sheet is also secured between the forward and rearward ends thereof to the second pivot pin in a longitudinally compressed manner so as to impart a waveform having a single wavelength to the sheet. A crank arm connects the first pivot pin to a double-acting cylinder for oscillating the first pivot pin to cause the rearward migration of the waveform in the sheet. A timing arm connects the second pivot pin to the double-acting cylinder for controlling the frequency of the oscillations delivered to the first pivot pin.

Apparatus constructed in accordance with this invention may be used for propelling both liquids and gasses. For this reason, the marine propulsion unit may be used not only to move boats and submarines through water but may, with suitable modification, be used to propel aircraft through the atmosphere. Furthermore, the marine propulsion unit may be substituted for existing pumps and blowers used to drive liquids and gasses through pipes and ducts. In all cases, the apparatus will operate without cavitation and substantially without noise.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a side view of a marine propulsion unit in accordance with the present invention with portions broken away to reveal details thereof.

FIG. 2 is a top view of the marine propulsion unit of FIG. 1.

Similar reference characters denote corresponding features consistently throughout the accompanying drawings.

DETAILED DESCRIPTION OF THE PREFERRED EMBODIMENT

Figure 5:
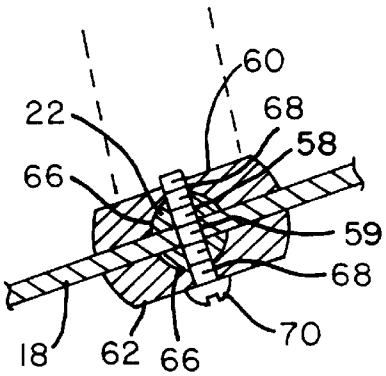
FIG. 5 is an enlarged view of a portion of the marine propulsion unit of FIG. 1.
Figure 4:
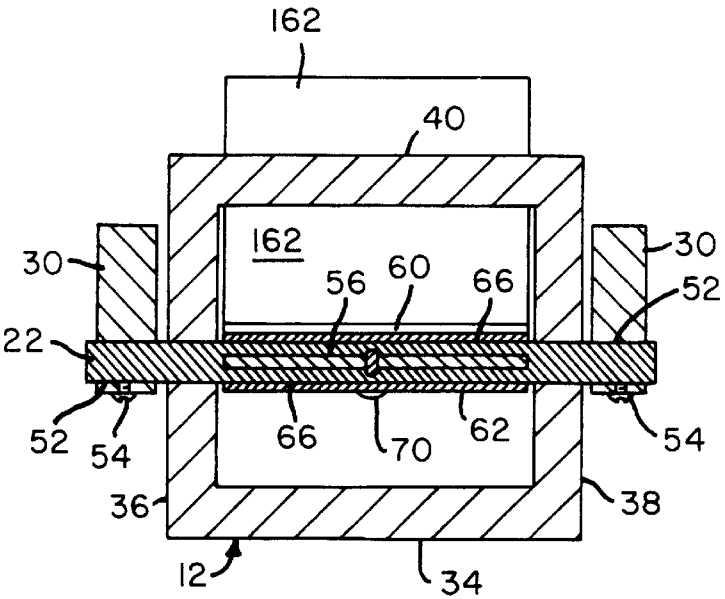
FIG. 4 is a cross-sectional view of the marine propulsion unit taken along line 4—4 of FIG. 1.
Figure 3:
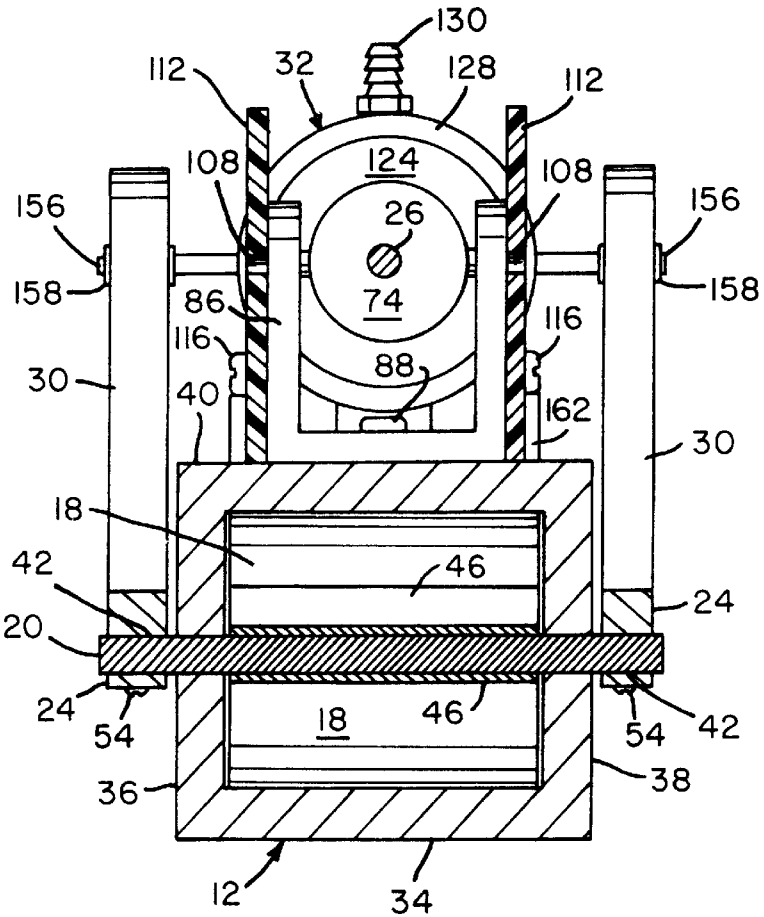
FIG. 3 is a cross-sectional view of the marine propulsion unit taken along line 3—3 of FIG. 1.

Referring now to the FIGS., a marine propulsion unit in accordance with the present invention is shown at 10. The propulsion unit 10 includes a conduit 12 having a forward, inlet end 14 and a rearward, outlet end 16. A flexible sheet 18 is secured within the conduit 12 in a longitudinally-compressed manner by pivot pins 20 and 22. The pivot pin 20 is linked by crank arms 24 to the piston rod 26 of a double-acting, pneumatic cylinder 28. When moved by the rod 26, the crank arms 24 oscillate the pin 20 about its longitudinal axis and drive a liquid-propelling waveform along the sheet 18 from the inlet end 14 to the outlet end 16 of the conduit 12. The action of the cylinder 28 is controlled by timing arms 30 which connect the pivot pin 22 to the pneumatic cylinder controller 32.

The conduit 12 has a box-like configuration and includes: a bottom wall 34, a pair of laterally-spaced side walls 36 and 38 extending upwardly from the bottom wall, and a top wall 40 vertically spaced from the bottom wall and connecting the side walls. The walls 34, 36, 38 and 40 are planar in form and are arranged so as to provide the conduit 12 with a rectangular cross section of constant dimensions along its length.

The pivot pin 20 is located adjacent the inlet end 14 of the conduit 12 with the end portions thereof journaled through the side walls 36 and 38. The end portions of the pivot pin 20 are received within apertures 42 provided in the lower ends of the crank arms 24 and secured therein by set screws 44. The center portion of the pivot pin 20, however, is secured within a sheet retainer 46 by a set screw 48. A slot 50 in the retainer 46 snugly receives the forward edge of the sheet 18.

The pivot pin 22 is located adjacent the outlet end 16 of the conduit 12 remote from pivot pin 20. As shown, the opposed end portions of the pivot pin 22 are journaled through the side walls 36 and 38 and are secured within apertures 52 in the lower ends of the timing arms 30 by set screws 54. The center portion of the pivot pin 20 has a slot 56 for the passage of the sheet 18. A transverse aperture 58 in the pivot pin 20 intersects the slot 56 and aligns with an aperture 59 in sheet 18.

The upper and lower sheet-retaining plates 60 and 62 sandwich the center portion of the pivot pin 22 and the sheet 18 passing through it. Each of the plates 60 and 62 has a groove 66 for accommodating the pivot pin 22 and also has a threaded aperture 68 transverse to the groove adapted for axial alignment with the aperture 58 in pivot pin 22 and for receiving a set screw 70. When the set screw 70 is tightened in the apertures 58 and 68, the plates 60 and 62 are drawn together to clamp the sheet 18.

The cylinder 28 includes an elongated, tubular body 72 having plugs 74 and 76 threaded into its forward and rearward ends. The plugs 74 and 76 have a diameter somewhat greater than that of the body 72 so as to provide the cylinder 28 with a rearwardly-facing shoulder 78 at its forward end and a forwardly-facing shoulder 80 at its rearward end. Adjacent the plugs 74 and 76, air passages 82 and 84 penetrate the body 72.

The cylinder 28 is supported at a fixed height above the conduit 12. A bracket 86, secured by threaded fasteners 88 to the plug 74 and to the top wall 40, supports the forward end of the cylinder 28 above the conduit 12. Similarly, a bracket 90, secured by threaded fasteners 92 to the plug 76 and to the top wall 40, supports the rearward end of the cylinder 28 above the conduit 12.

Positioned within the tubular body 72 of the cylinder 28 is a piston 94 adapted to slide between the plugs 74 and 76. The piston rod 26 extends forwardly from the piston 94 and through an aperture 96 in the plug 74. Threads 98 are provided on the forward end of piston rod 26 for engagement with a threaded aperture 100 in the center portion 101 of a connecting rod 102 and with a lock nut 104.

The connecting rod 102 includes a pair of tapered end portions 106 which extend outwardly from the opposite sides of the center portion 101. Each of the end portions 106 extends loosely through a pair of adjacent, longitudinal slots 108 and 110 respectively provided in one of a pair of bracket extension members 112 and in the upper end of one of the crank arms 24. To eliminate binding within the slots 110, the end portions 106 are covered with bushings 114 made from a plastic having a low coefficient of friction.

The extension members 112 are preferably formed of the same plastic used to make the bushings 114 and are secured by screws 116 to the opposite sides of the bracket 86. The slots 108 in the extension members 112 are axially aligned with the longitudinal axis of the cylinder 28 and have a length substantially equal to that of the piston rod 26. The slots 108 extend both forwardly and rearwardly of the pivot pin 20.

Slidably engaged with the exterior of the cylinder 28 is the controller 32. Preferably, the controller 32 has an air supply chamber 118 for delivering compressed air into the cylinder 28. A connector 120 is secured to the rearward end of the chamber 118 for transferring the motion of the timing arms 30 to the chamber.

The chamber 118 includes a cylindrical side wall 122 and opposed end walls 124 and 126. Preferably, the side wall 122 has a length about seventy-five percent of that of the body 72 and a diameter somewhat greater than that of the body so as to provide an annular space therebetween. An integral ring 128 projects outwardly from the side wall 122 and provides a reinforced platform for the threaded fastening of an air supply fitting 130 which may be attached by a hose (not shown) to a source of pressurized air. External threads 132 adjacent the end wall 126 are provided to the side wall 122 for attachment of the connector 120.

The forward end wall 124 is integrally formed with the side wall 122. As shown, the end wall 124 includes an aperture 132 for slidably engaging the tubular body 72. The aperture 132 is provided with a peripheral, beveled surface 134 for sealed engagement with O-rings 136 secured around the body 72 and against the shoulder 78.

For ease of manufacture, the rearward end wall 126 is formed separately from the side wall 122 but is clamped against the side wall 122 during use of the unit 10 by the connector 120. The end wall 126 includes an aperture 138 for Slidably engaging the tubular body 72. The aperture 138 is provided with a peripheral, beveled surface 140 for sealed engagement with O-rings 142 secured around the body 72 and against the shoulder 80.

The connector 120 includes a pair of rings 144 and 146 joined together by a fingers 148 which are positioned to avoid contact with either the plug 76 or bracket 90. The ring 144 has interior threads 150 terminating at an abutment surface 152 adapted to hold the end wall 126 against the side wall 122 of the cylinder 28 when the threads 132 and 150 are fully engaged. The ring 146, on the other hand, has small openings 154 in its opposite sides for the passage of a connecting rod 156. The connecting rod 156 has bushings 158 at its opposite ends adapted for positioning within longitudinal slots 160 in the upper ends of the timing arms 30.

The sheet 18, like the remainder of the unit 10 not described above as having been formed of plastic, is preferably made from a durable, non-corroding, metal alloy. Between the pivot pins 20 and 22, the sheet 18 is compressed into a sinusoidal waveform whose wavelength is the distance between the pins 20 and 22. The amplitude of the waveform is, of course, limited by the distance between the bottom and top walls 34 and 40 of the conduit 12.

The sheet 18 has an uncompressed tail or rearward extension 162 that projects from the pivot pin 22 and out the outlet end 16 of the conduit 12. The length of the extension 162 can be varied depending on the viscosity of the liquid being pumped through the conduit 12 and the relative stiffness of the alloy used to form the sheet 18 and its extension 162. Preferably, however, the length of the extension 162 is about the same as the distance between the pins 20 and 22. Such a length is believed to permit the extension 162 to obtain an additional propulsive force from liquid vortices radiating from the outlet end 16 of the conduit 12 during use of the unit 10.

The unit 10 is preferably used by mounting such on the hull of a boat (not shown) so that the conduit 12 is oriented in the fore-and-aft direction of the boat and submerged when the boat is afloat. The upper wall 40 of the conduit 12 may form a portion of the boat hull or such may be suspended outside the hull. The cylinder 28 and controller 32 are preferably positioned within the hull of the boat or above the water line during use to reduce drag.

Compressed air imparts motion to the sheet 18. Starting with the piston 94 and end wall 124 of the chamber 118 positioned adjacent the plug 74 as shown in FIG. 1, compressed air is delivered to the chamber 118 via fitting 130. Air flows from the chamber 118 through passages 82 and into the tubular body 72 thereby driving the piston 94, piston rod 26 and connecting rod 102 rearwardly. The rearward motion of the rod 102 rotates the crank arms 24 and pivot pin 20 clockwise with respect to FIG. 1. The rotation of the pivot pin 20, in turn, is transferred through the retainer 46 to the sheet 18 whose forward edge is stiffened thereby.

As the forward edge of the sheet 18 is rotated, the waveform provided thereto migrates rearwardly. Movement of the waveform draws liquid into the conduit 12 through inlet end 14, propels liquid rearwardly through the conduit, and expels liquid from the outlet end 16. Water expelled from the outlet end 16 delivers a forwardly-directed, propulsive force to the sheet 18 and its extension 162.

When the piston 94 reaches the limit of its rearward travel near the plug 76, the waveform in the sheet 18 will have shifted one hundred and eighty degrees in phase. The movement of the sheet 18 as a result of the phase shift causes the pivot pin 22 and timing arms 30 to rotate clockwise with respect to FIG. 1. Rotation of the timing arms 30 moves the connecting rod 156, connector 120 and chamber 118 rearwardly so that passages 82 are open to the atmosphere and the beveled surface 140 of end wall 126 forms a seal with O-rings 142. Compressed air is now free to travel from the chamber 118 through the passages 84 into tubular body 72. As a result, the piston 94 is driven by compressed air to its original position at the forward end of the tubular body 72.

The forward movement of the piston 94 pivots the forward edge of the sheet 18 around the longitudinal axis of pivot pin 20, again causing the waveform to migrate rearwardly. To accomplish this result, the piston 94 drives the piston rod 26 and connecting rod 102 forwardly. The forward motion of the connecting rod 102 rotates both the crank arms 24 and pivot pin 20 counterclockwise. The rotation of the pivot pin 20 is transferred through the retainer 46 to the sheet 18 thus migrating the waveform—the result again being the application of a forwardly-directed, propulsive force to the sheet 18 and extension 162.

When the piston 94 returns to the limit of its forward motion, i.e., the position shown in FIG. 1, the waveform provided to the sheet 18 will have again shifted one hundred and eighty degrees in phase. This particular phase shift causes the pivot pin 22 and timing arms 30 to rotate clockwise. Clockwise motion of the arms 30 moves the connecting rod 156, connector 120 and chamber 118 forward and opens the passages 84 to the atmosphere. Compressed air is now free to flow through the passages 82 and the above described pumping process repeated.

The pumping cycle whereby a liquid is moved through the conduit 12 by movement of the sheet 18 can be repeated as many times as desired. The rate at which pumping occurs may regulated by controlling the flow rate and pressure of the compressed air delivered to the chamber 118 through fitting 130.

While the invention has been described with a high degree of particularity, it will be appreciated by those skilled in the art that modifications may be made thereto. For example, various motors may be substituted for the pneumatic cylinder 28 for oscillating the crank arms 24. Furthermore, the sheet 18 and the extension 162 need not be integrally formed but may be separate pieces of flexible material clamped together by the plates 60 and 62. Therefore, it is to be understood that the present invention is not limited to the sole embodiment described above, but encompasses any and all embodiments within the scope of the following claims.

I claim:

1. A marine propulsion unit, comprising:

a conduit having opposed, inlet and outlet ends;

a first pivot pin pivotally secured within said conduit adjacent said inlet end of said conduit;

a second pivot pin pivotally secured within said conduit adjacent said outlet end of said conduit;

a flexible sheet having a forward end secured to said first pivot pin and a rearward end extending outwardly and freely from said outlet end of said conduit, said flexible sheet being secured to said second pivot pin between said forward and rearward ends thereof in a longitudinally compressed manner so as to impart a waveform to said flexible sheet; and, at least one oscillating crank arm secured to said first pivot pin for oscillating said first pivot pin to cause the rearward migration of said waveform in said flexible sheet from said first pivot pin to said second pivot pin.

2. The marine propulsion unit according to claim 1 wherein said waveform is a single wavelength in length.

3. The marine propulsion unit according to claim 1 wherein said rearward end of said flexible sheet extends from said conduit a distance substantially equal to that separating the first pivot pin from said second pivot pin.

4. The marine propulsion unit according to claim 1 further comprising means for oscillating said crank arm.

5. The marine propulsion unit according to claim 4 wherein said oscillating means comprises a double-acting cylinder.

6. The marine propulsion unit according to claim 5 further comprising at least one oscillatable timing arm secured to said second pivot pin adapted to oscillate in response to the migration of said waveform in said flexible sheet, said timing arm being associated with said double-acting cylinder so as to control the oscillations imparted to the crank arm.

7. A marine propulsion unit, comprising:

a conduit having opposed, inlet and outlet ends;

a first pivot pin pivotally secured within said conduit adjacent said inlet end of said conduit;

a second pivot pin pivotally secured within said conduit adjacent said outlet end of said conduit;

a flexible sheet having a forward end secured to said first pivot pin and a rearward end extending outwardly and freely from said outlet end of said conduit, said flexible sheet being secured to said second pivot pin between said forward and rearward ends thereof in a longitudinally compressed manner so as to impart a waveform to said flexible sheet;

a pair of oscillating crank arms secured to said first pivot pin for oscillating said first pivot pin to cause the rearward migration of said waveform in said flexible sheet from said first pivot pin to said second pivot pin; and, means for oscillating said crank arms.

8. The marine propulsion unit according to claim 7 wherein said waveform is a single wavelength in length.

9. The marine propulsion unit according to claim 7 wherein said rearward end of said flexible sheet extends from said conduit a distance substantially equal to that separating the first pivot pin from said second pivot pin.

10. The marine propulsion unit according to claim 7 wherein said oscillating means comprises a double-acting cylinder.

11. The marine propulsion unit according to claim 10 further comprising a pair of timing arms secured to said second pivot pin adapted to oscillate in response to the migration of said waveform in said flexible sheet, said timing arm being associated with said double-acting cylinder so as to control the oscillations imparted to said crank arms.

12. A marine propulsion unit, comprising:

a conduit having opposed, inlet and outlet ends and including:

a bottom wall;

a pair of laterally-spaced side walls extending upwardly from said bottom wall; and, a top wall spaced from said bottom wall and connecting said side walls;

a first pivot pin having opposed ends extending respectively and pivotally through said side walls adjacent said inlet end of said conduit;

a second pivot pin having opposed ends extending respectively and pivotally through said side walls adjacent said outlet end of said conduit;

a flexible sheet having a forward end secured to said first pivot pin and a rearward end extending freely from said outlet end of said conduit, said flexible sheet being secured to said second pivot pin between said forward and rearward ends thereof in a compressed waveform;

a double-acting, pneumatic cylinder secured to said top wall of said conduit, said cylinder including:

an elongated tubular body positioned substantially parallel to said conduit, said tubular body having open forward and rearward ends and a first air passage positioned adjacent said forward end and a second air passage positioned adjacent said rearward end;

a first plug secured within said open forward end of said tubular body, said first plug extending radially outward from said tubular body so as to form a rearwardly-facing shoulder, said first plug also having a longitudinal aperture;

a second plug secured within said. open rearward end of said tubular body, said first plug extending radially outward from said tubular body so as to form a forwardly-facing shoulder;

a plurality of O-rings respectively positioned snugly about said tubular body and against said rearwardly-facing shoulder and said forwardly-facing shoulder;

a piston positioned within said tubular body for movement between said air passages; and, a piston rod extending forwardly from said piston and having a free end extending through said longitudinal aperture in said first plug;

a pneumatic cylinder controller for controlling the action of said pneumatic cylinder, said controller including an air supply chamber slidably positioned on said tubular body and a connector extending rearwardly therefrom, said air supply chamber including:

a cylindrical side wall having forward and rearward ends, said cylindrical side wall being sized to loosely receive a portion of said tubular body therein, said cylindrical side wall having a length less than the distance between said first and second air passages;

a first end wall secured to said forward end of said cylindrical side wall, said first end wall having a central aperture for slidably engaging said tubular body; and, a second end wall secured to said rearward end of said cylindrical side wall, said second end wall having a central aperture for slidably engaging said tubular body;

a pair of crank arms for oscillating said first pivot pin, each of said crank arms being secured at one end thereof to one of said opposed ends of said first pivot pin and each being secured at the other end thereof to said free end of said piston rod; and, a pair of timing arms adapted to oscillate in response to the migration of said waveform in said sheet and slide said air supply chamber longitudinally or. said tubular body, said timing arms each being secured at one end thereof to one of said opposed ends of said second pivot pin and each being secured at the other end thereof to said connector of said controller.

13. The marine propulsion unit according to claim 12 wherein said waveform is a single wavelength in length.

14. The marine propulsion unit according to claim 12 wherein said rearward end of said flexible sheet extends from said conduit a distance substantially equal to that separating the first pivot pin from said second pivot pin.

* * * * *